United States Patent [19]

Ebrahim et al.

[11] Patent Number: 4,684,024

[45] Date of Patent: Aug. 4, 1987

[54] COVER FOR BAKED GOODS

[75] Inventors: Sajjad Ebrahim, Willowdale; Donald K. Hexamer, Brantford, both of Canada

[73] Assignee: Par-Pak Limited, Richmond Hill, Canada

[21] Appl. No.: 828,252

[22] Filed: Feb. 11, 1986

[30] Foreign Application Priority Data

Dec. 19, 1985 [CA] Canada ..... 498122

[51] Int. Cl.[4] ..... B65D 45/04

[52] U.S. Cl. ..... 206/464; 229/43; 229/45 R; 426/106

[58] Field of Search ..... 150/55; 206/461, 464, 206/465, 467; 229/43, 45 R; 426/94, 106, 124, 128, 411

[56] References Cited

U.S. PATENT DOCUMENTS

| | | | |
|---|---|---|---|
| 2,687,157 | 8/1957 | Cowan | 150/55 |
| 2,944,725 | 7/1960 | Hayes | 229/43 |
| 3,690,902 | 9/1972 | Dahl | 150/55 |
| 3,902,540 | 9/1975 | Commisso | 150/55 |
| 3,937,326 | 2/1976 | Schick | 206/465 |
| 4,132,344 | 1/1979 | Jewell | 150/55 |
| 4,452,356 | 6/1984 | Dahl | 206/45.32 |

FOREIGN PATENT DOCUMENTS

| | | | |
|---|---|---|---|
| 2427937 | 2/1975 | Fed. Rep. of Germany | 229/43 |

*Primary Examiner*—Stephen Marcus
*Assistant Examiner*—Jimmy G. Foster
*Attorney, Agent, or Firm*—Riches, McKenzie & Herbert

[57] ABSTRACT

A package is disclosed to enclose bakery items, particularly cakes. The package has a transparent, lightweight, domed plastic cover and a flat base upon which the cake is received. The cover has catch means provided on its side walls at circumferentially spaced locations to be engaged by U-shaped hook members partially cut from outwardly extending projections from the base. The hook members are bendable upwardly to positions in which their blights overlie and engage catch means on the cover to couple the cover to the base.

6 Claims, 8 Drawing Figures

FIG. 2.
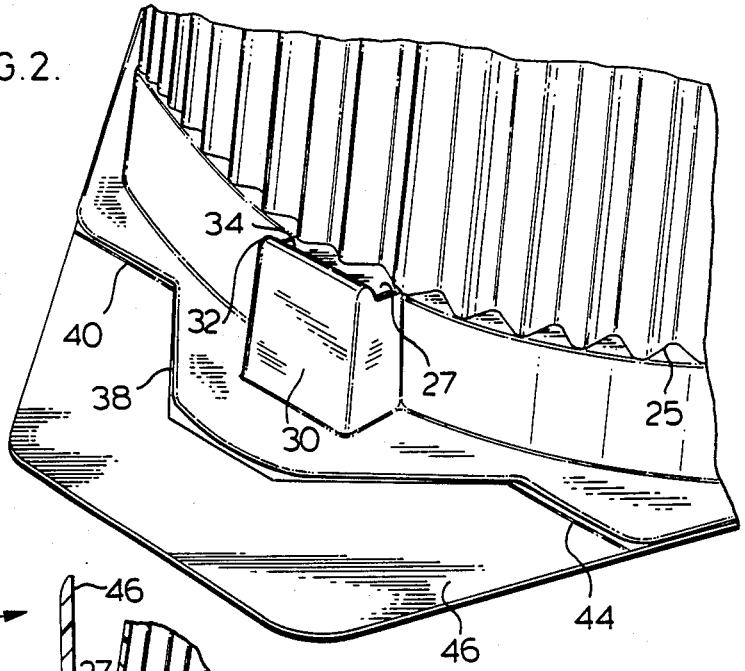
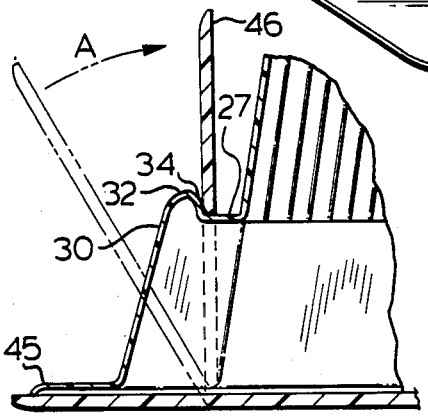
FIG. 4.
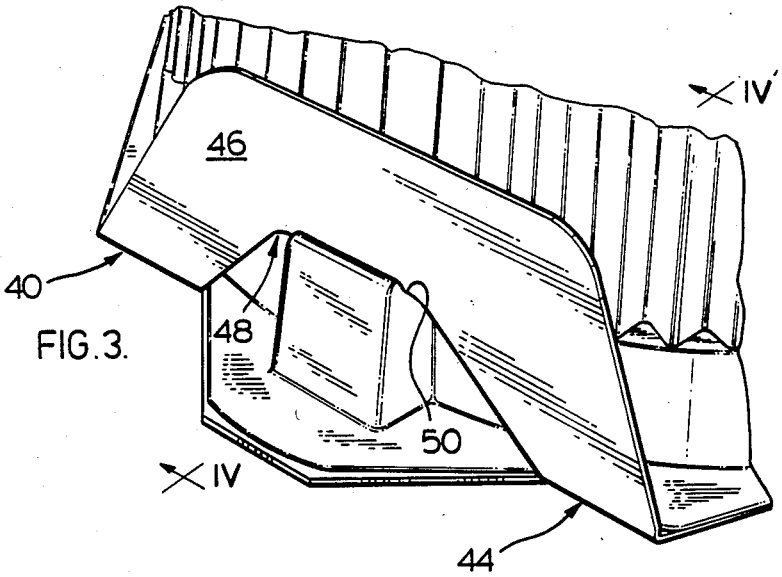
FIG. 3.

COVER FOR BAKED GOODS

SCOPE OF THE INVENTION

This invention relates to packaging for bakery items and more particularly to packaging for cakes.

BACKGROUND OF THE INVENTION

Known packages for cakes such as disclosed in U.S. Pat. No.4,425,356 to Dakl have a base and a domed plastic cover secured to the base by sticky tabs on the cover being placed in overlying contact with complementary tabs on the base. Such packages have the disadvantage of failing to provide secure coupling of the plastic cover to the base under varying conditions to which the package may be subjected. For example, the reusable adhesive between tabs on the base and cover may become inoperative due to cold temperatures or excessive heat. The adhesion between tabs may not be strong enough to withstand forces to which the packaging may be subjected. In use of known adhesive packages, if the cake, its icing or other substances such as flour come into contact with the adhesive on the tabs, the tabs will foul and not hold the cover on the base. In manufacture, such known adhesive packages suffer the disadvantage that application of the re-usable adhesive is difficult, expensive and limits the nature of materials which can be used for the base.

SUMMARY OF THE INVENTION

Accordingly, it is an object of the present invention to at least partially overcome these disadvantages of previously known devices by providing a packaging having a base and a cover with catch means on the cover to be engaged by U-shaped hook members partially cut from projections from the base with the lock members bendable into positions in which their blights engage the catch means on the cover.

Another object is to provide a simple, inexpensive cake packaging with the cover mechanically coupled to the base.

In one of its aspects the present invention provides a package for bakery items comprising thin planar base means to support bakery items thereon, removable cover means comprising transparent thermoplastic material and having a top wall and side walls depending peripherally from the top wall, the side walls having a bottom edge thereof resting on the periphery of the base means, the side walls having a plurality of circumferentially spaced integral catch means projecting outwardly from the side walls, each catch means having an upwardly directed catch surface at a height above the bottom edge, the base means having a plurality of circumferentially spaced, outwardly projecting hook-forming portions which extend outwardly beyond the bottom edge of the cover means, one hook-forming portion below each catch means, a U-shaped cut line through each hook-forming portion outward of the bottom edge defining between the cut line and the outer edge of the base means an outer hook member with an inwardly facing blight bordering on the cutline, a first straight score line on each hook-forming portion extending from a first end of said cut line to the edge of the base means, a second straight score line on each hook-forming portion extending from the other, second end of said cut line to an edge of the base means, the second score line lying along an extension of the first score line, each hook member bendable with respect to the remainder of the base means about the first and second score lines to pivot the hook member upwardly toward the cover means to a position with the blight portion of the hook member overlying a respective catch means with the blight of the hook member engaged on the upper catch surface of the catch means to securely couple the cover means to the base means.

In another aspect the present invention provides a package for bakery items comprising two enclosure forming means, one of the enclosure forming means providing a support surface to support bakery items thereon and the other of said enclosure forming means providing a co-operating cover, each of the enclosure forming means having peripheral edges and located proximate thereto peripheral contact surfaces to contact peripheral contact surfaces of the other enclosure forming means and define therebetween a substantially sealed enclosed enclosure to receive bakery items, a first of the enclosure forming means having side walls and at least one catch means projecting outwardly from one side wall thereof, a hook forming portion on the second enclosure forming means outward beyond the peripheral edge of the first enclosure forming means below the catch means, the hook forming portion including a U-shaped hook member with an inwardly facing blight, the hook member bendable with respect to the remainder of the hook forming portion about straight fold lines located on the hook forming member on either side of the catch means to pivot the hook member to a position with its blight portion engaging the catch means to securely couple the first and second enclosure forming means together to define said enclosure.

DESCRIPTION OF THE DRAWINGS

Other objects and advantages of the present invention will appear from the following description taken together with the accompanying drawings in which:

FIGS. 2 and 3 show enlarged pictorial views of the package of FIG. 1 but, respectively, with the cover merely resting on the base, and with the cover coupled to the base, FIG. 4 is a cross-sectional view along line IV—IV' in FIG. 3.

DETAILED DESCRIPTION OF THE DRAWINGS

Figure 1:
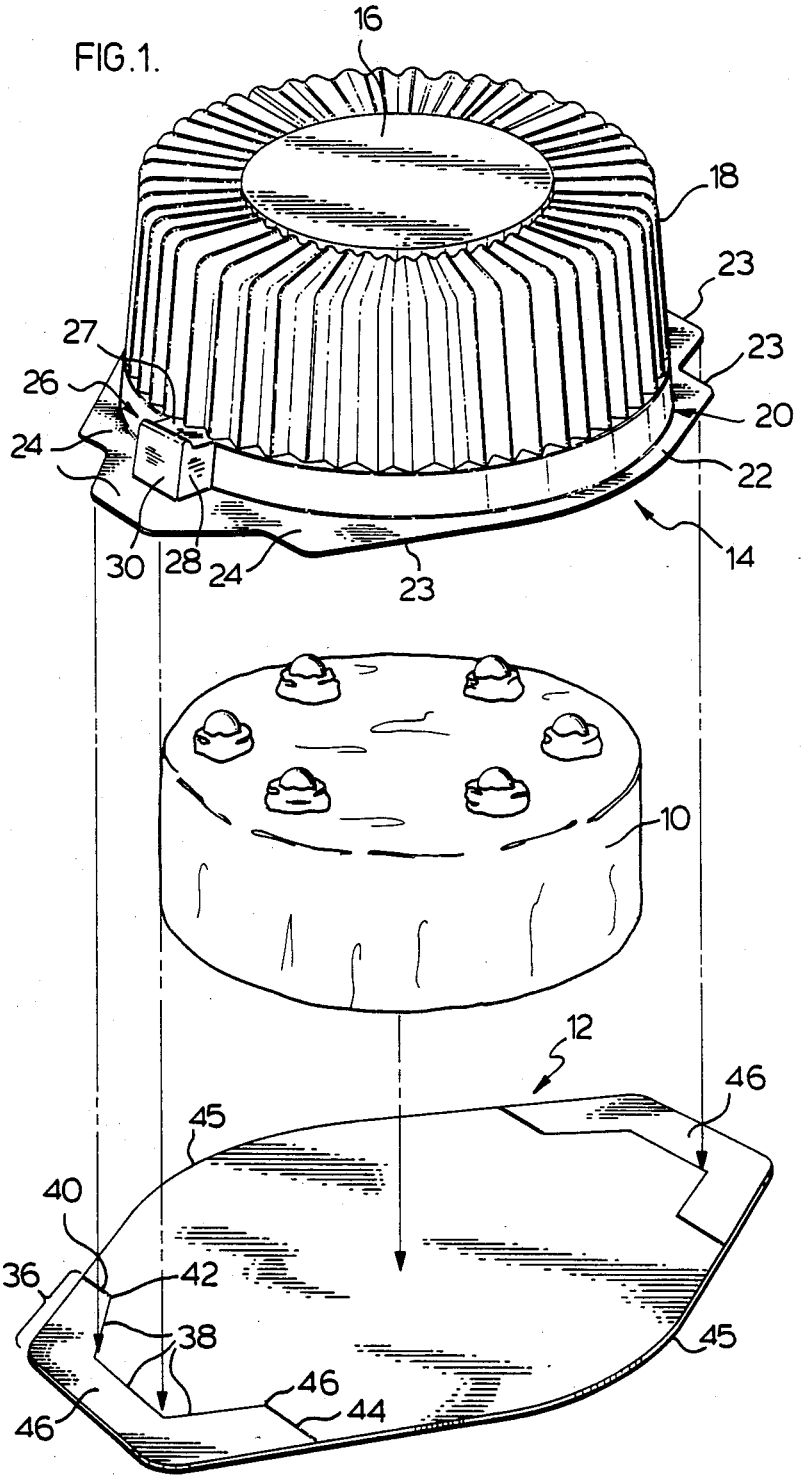
FIG. 1 is an exploded pictorial view showing a cake package in accordance with a preferred embodiment of the present invention.

Reference is made first to FIG. 1 which shows an exploded view of a package in accordance with the present invention adapted to enclose a cake 10. The package includes base 12 and dome-like cover 14.

Cover 14 has an end wall or top 16 with side wall 18 depending downward therefrom to its bottom edge 20 including outwardly extending flange 22. Flange 22 has portions 24 of increased width below catch members 26 provided at circumferentially spaced locations. Each catch member 26 has a horizontal upper catch surface 27, side surfaces 28 and on outwardly facing, upwardly and inwardly sloping cam surface 30. Cam surface 30 has an upper end 32 raised above catch surface 27 to define at the outer end of catch surface 27, an inwardly facing shoulder 34.

Base member 12 has an outer perimeter defined by edge 45 which is only marginally greater than the outer perimeter of cover 14 other than below catch members 26 where hook-forming portions generally designated 36 are provided to extend outwardly substantially beyond portions 24. Each hook-forming portion 36 carries a generally U-shaped cut line 38 therethrough with the U of the U-shaped cut line 38 opening inwardly. On hook forming portion 36, two straight score lines are provided. A first score line 40 extends from one end 42 of cut line 38 to the perimeter or outer edge 45 of base 12. A second score line 44 extends from the outer end 46 of cut line 38 to the outer edge 45 of base 12. Second score line 44 is an extension of first score line 40.

Between cut line 38 and the outer edge 45 of base 12, there is defined a hook member 46 having a blight 48 bordering along cut line 38. Blight 48 opens inwardly. Hook member 46, as a unitary planar member, may be bent with respect to the rest of base 12 about the first and second score lines 40 and 44 so as to pivot hook member 46 upwardly from the plane of base member, as for example, shown in FIG. 4 by arrow A.

In use of the package of the present invention, cake 10 is placed on base 12. Cover 14 is then placed over cake 10 with bottom edge 20 including flange 22 resting on the outer periphery of base 12 with each catch member 26 aligned to overlie the hook-forming portions 36 of base 12. In this position, hook-forming portions 36 extend outwardly beyond edge 23 of flange 22 of bottom edge 20 as seen in FIG. 2. In this position, cut line 38 and score lines 40 and 44, on hook-forming portion 36, are outward of flange 22 and hook member 46 may be pivoted about score lines 40 and 44 upward towards cover 14 as seen in FIG. 4.

Both hook members may be pivoted upwardly until blight 48 contacts cam surface 30. By contact between cam surface 30 and blight 48, on further pivoting of hook member 46, cam surface 30 cams blight 48 upward over upper end 32 so that blight 48 engages catch surface 27 inwardly of shoulder 34 as seen in solid lines in FIGS. 4 and 5.

Blight 48 has a central flat portion 50 which engages flat upper cam surface 27. Cam surface 27 is located above base 12 a vertical distance similar to that between first score line 40 and the central flat portion 50 of blight 48. Preferably these distances are chosen having regard to the resiliency of cover 14 and particularly flange 22 so that cover 14 is urged downwardly onto base 12 with bottom edge 20 of cover 14 in substantially air-tight, sealed relation about the entire periphery of base 12.

Figure 5:
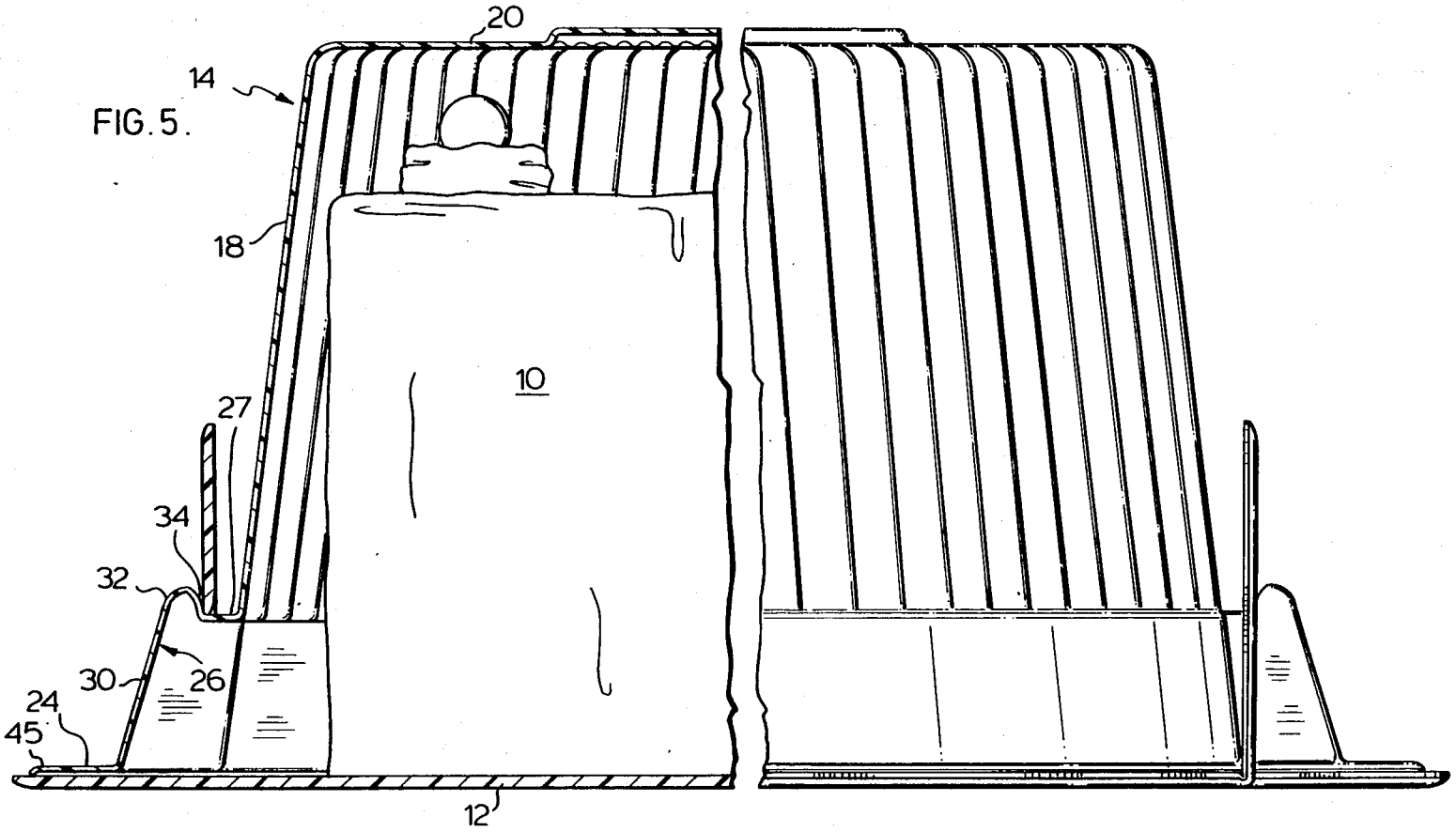
FIG. 5 is a partially cut-away side view of the cake package of FIG. 1.

Hook member 46 is seen in FIGS. 4 and 5 when coupling the cover to the base to assume a position with hook member 46 relatively closely adjacent side walls 18 of cover 14 so that the coupled package does not assume a greater horizontal dimension than that of base 12.

In the coupled position shown in FIGS. 4 and 5, inwardly facing shoulder 34 can abut blight 48 to resist pivoting of hook member 46 away from cover 14 so as to take blight 48 out of engagement with catch surface 27. To uncouple the cover from the base, hook member 46 must be forced over shoulder 34. The cover 14 and base 12 preferably together provide inherent resiliency so as to permit flexing of the cover or base to pass hook member 46 over raised upper end 32 of catch member 26. As seen in FIG. 4, flange 22 preferably is marginally downtuned at edge 45 to provide some resiliency and assist sealing engagement with base 12.

The cover is preferably formed from a lightweight thermoplastic sheet. Preferably the material will be transparent and permit the cake to be seen with good clarity. The cover may be clear or have any desired tint or colour. Cover 14 needs to have sufficient rigidity to maintain its shape. Increased rigidity is advantageous to increase the extent to which cake 10 is protected. A suitable material for cover 14 is biaxially orientated polystyrene. Other suitable materials include polyethylene, polyvinylchloride BAREX (trade mark) resin or PETG (trade mark) resin.

Cover 14 may be made of inexpensive, food grade materials and does not necessarily need to be sterilized.

Base 12 may be made from materials including paperboard, corrigated cardboard, polystyrene and aluminum. The base should be lightweight and only needs sufficient strength to protect the product. Base 12 could be made of the same material as cover 14.

The package shown in the drawings is reusable with each hook member capable of being pivoted to look over catch members a plurality of times.

Base 12 is shown as a flat sheet. The base need not be flat and a central depression could be provided sized to receive cake 10.

Both base 12 and cover 14 should be able to withstand freezing conditions to permit freezing of the cake within the package.

Cover 14 need not provide an air tight seal with base 12. Preferably a sufficient seal will be formed to keep the cake fresh and moist and to keep other odors from entering into the package.

Side wall 18 has been shown to have a generally frusto-conical configuration tapering upwardly. Flutes or castillations 25 are provided in side wall 18 and top 16 to provide increased strength.

The cover and base shown in FIGS. 1 to 5 are particularly adapted to package cake 10 with the top 16 larger than the cake and side wall 18 taller than the cake so that the cake is spaced from the cover. The package of the present invention may assume virtually any configurations to cover other bakery items. For example it could cover muffins in base configured to hold a plurality of muffins.

Base 10 is generally circular with two hook-forming members at diametrically located positions. Three or more catch members could be provided. The base could for example, be rectangular with hook members overlying catch members at two or more corners or on the sides of the rectangular base.

Catch members 26 are shown integrally formed in cover 14, as is preferable to minimize manufacturing costs.

In the package shown in FIGS. 1 to 5, the outer edge 23 of flange 22 is sized to lie closely inward of the outer edge 45 of base 12. Outer edge 23 over enlarged portions 24 of flange 22 needs to be inward of cut line 38 and score lines 40 and 44 so that hook member 46 may pivot upwardly. Enlarged flange portions 24 provide increased strength but are not necessary. For example, the cover need not have enlarged portions 24 or even flange 22 at all and could end at the bottom of vertical portions of wall 18, cam surface 30 and catch side walls 28. Further, it is not necessary that flange 22 end inwardly of base 12 other than over portions 24. For example, the edge 23 of flange 22 could extend beyond base 12 between portions 24.

Preferably, the blight 48 of hook members 46 and catch member 26 may have complementary shapes and sizes. For example the catch means may have an outer cross-sectional profile along a plane in which the first score line 40 lies, which profile corresponds closely in size and shape to the size and shape of blight 48. In this case central and side portions of blight 48 may engage the upper catch surface 27 and side surfaces 28, respectively of catch member 26. This can assist in preventing rotation of cover 14 with respect to base 12.

Figure 6:
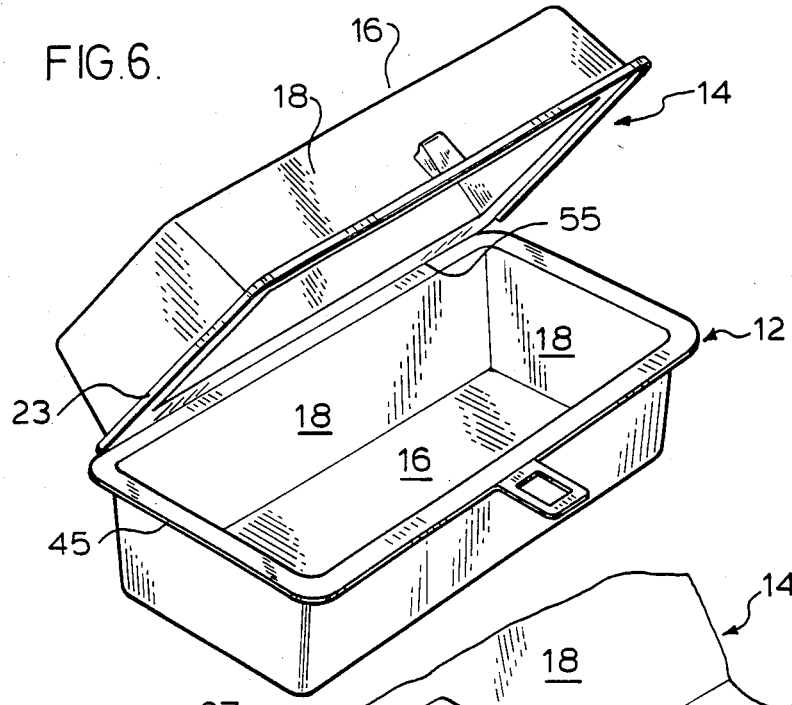
FIG. 6 is a pictorial view of a second preferred embodiment of a package in accordance with the present invention.
Figure 7:
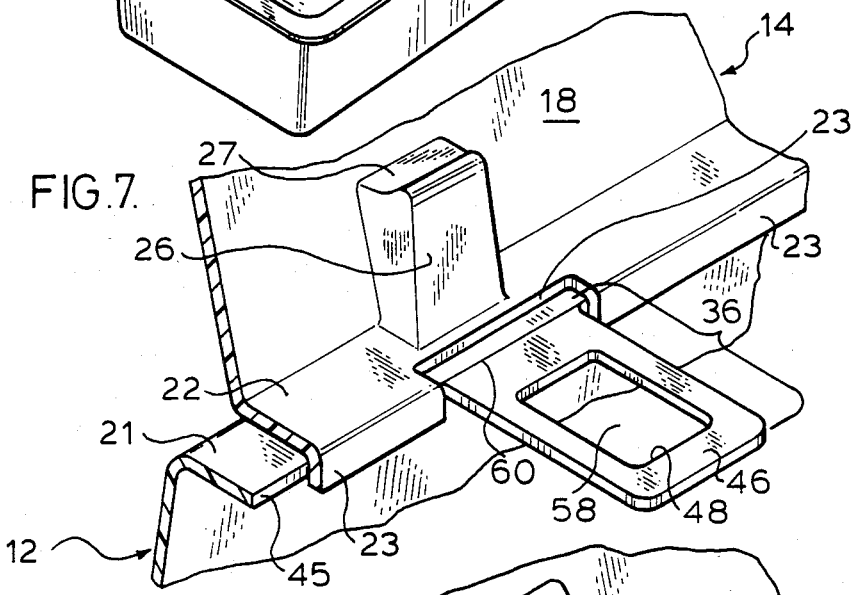
FIGS. 7 and 8 are enlarged views of the package of FIG. 6 in locked and unlocked closed positions.
Figure 8:
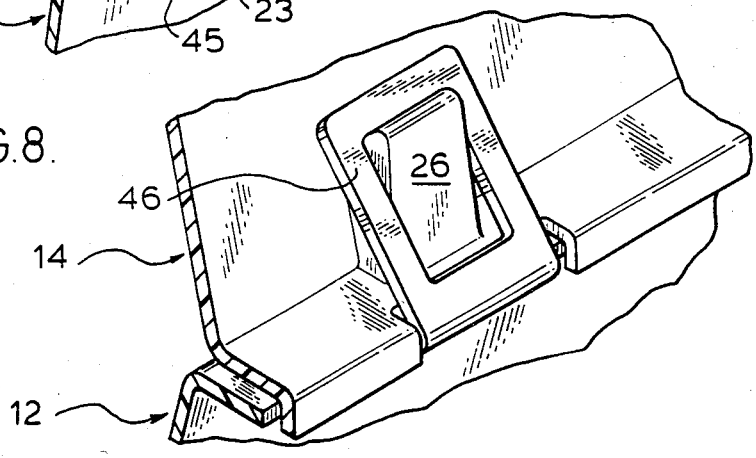

Reference is now made to the second preferred embodiment illustrated in FIGS. 6 to 8 in which similar reference numbers to those used in FIGS. 1 to 5 indicate similar elements.

The package of FIG. 6 comprises a one piece unitary piece of transparent thermoplastic material in the form of two enclosure forming members indicated as 12 and 14. Each has an end wall 16 and side walls 18 peripherally depending from end wall 16 to peripheral edges 45 and 23, respectively. The two members 12 and 14 are hinged together along a common peripheral edge portion indicated as 55 for relative pivoting between open and closed positions. Each member 12 and 14 has bordering its peripheral edge a peripheral flange or contact surface 21 and 22 respectively. When closed upon each other contact surfaces 21 and 22 of each member 12 and 14 meet the contact surfaces of the other member in abutting relation to form a substantially sealed enclosure between the two enclosure forming members adapted to receive items, preferably bakery goods therein. Catch member 26 is provided on a side surface of member 14 opposite to the hinged edge portion 55. Catch member 26 projects outwardly from side wall 18 defining a catch surface 27 directed away from member 12.

Number 12 has a hook-forming portion 36 outward of peripheral edge 23 of member 14 below catch member 26. A U-shaped hook member 46 is defined on hook-forming portion 36 with an inwardly opening blight 48 defined by a central aperture 58, formed, for example, by a central portion of hook-forming portion 36 being cut-away and removed.

Hook member 46 is pivotable about a fold line 60 having portions on each side of catch member 26 so that the hook member may be pivoted relative to the rest of the hook-forming portion toward catch member 26 with blight 48 to become engaged on catch surface 27 to securely lock members 12 and 14 together.

When the rectangular package is to receive bakery goods, either end wall 16 of the two members can serve as a base upon which the bakery item may rest with the other member to serve as a cover. Rather than provide the two members 12 and 14 hinged together, catch members and complementary hook members may be provided on opposite side walls.

As seen in FIGS. 7 and 8, edge 23 of member 14 may terminate under catch member 26 inwardly of where edge 23 occurs on other portions of member 14. This permits fold line 60 to be located sufficiently inwardly that when hook members 46 is folded upwardly to engage catch member 26 as seen in FIG. 8, neither hook-forming portion 36 nor hook member 26 extend beyond edge 25 of the package.

While the invention has been described with reference to preferred embodiments, it is not so limited. Many modifications and variations will now occur to those skilled in this art. For a definition of the invention, reference is made to the following claims.

What we claim is:

1. A package for bakery items comprising:

thin planar base means of expanded polystyrene to support bakery items thereon, removable cover means comprising transparent thermoplastic material and having a top wall and side walls depending peripherally from the top wall, the side walls rising upwardly toward the top wall from a bottom edge portion of the cover means substantially lying in the plane of the base means and resting on the periphery of the base means, the bottom edge portion comprising a flange-like border member which extends outwardly to where the cover means terminates as a peripheral side edge of the border member, the side walls having a plurality of circumferentially spaced integral catch means projecting outwardly from the side walls, each catch means rising upwardly from the bottom edge portion to an upwardly directed catch surface at a height above the border member, the border member encircling the side walls and their catch means outwardly thereof continuously about the entire perimeter of the cover means so as to space upwardly rising portions of the side walls and their catch means from the peripheral side edge, the base means having a plurality of circumferentially spaced, outwardly-projecting hook-forming portions which extend outwardly beyond the peripheral side edge of the cover means, one hook-forming portion below each catch means, a U-shaped cut line through each hook-forming portion located marginally outward of the peripheral side edge and defining between the cut line and an outer edge of the base means an outer hook member with an inwardly facing blight bordering on the cut line, a first straight score line on each hook-forming portion located marginally outward of the peripheral side edge and extending from a first end of said cut line to the edge of the base means, a second straight score line on each hook-forming portion located marginally outward of the peripheral side edge and extending from the other, second end of said cut line to the edge of the base means, the second score line lying along an extension of the first score line, the peripheral side edge of the cover means over the hook-forming portion being located substantially coincident with each of the first score line, the cut line and the second score line marginally inwardly thereof, each hook member bendable with respect of the remainder of the base means about the first and second score lines to pivot the hook member upwardly toward the cover means to a position with the hook member overlying a rerespective catch means with the blight of the hook member engaged on the upwardly directed catch surface of the catch means to securely couple the cover means to the base means, base means, the base means providing a continuous, planar support surface underlying the entirety of the cover means within an area defined by the peripheral side edge, and said blight including a wide, flat central section parallel to said first score line, the upwardly directed catch surface having a width marginally less than that of said central section with the upwardly directed catch surface disposed parallel to said central section for engagement by the central section over substantially the entire width of the central section.

2. A package as claimed in claim 1 wherein the width of the central section is approximately the same as the height of the catch surface above the border member.

3. A package as claimed in claim 2 wherein the side walls comprise a generally frusto-conical segment enlarging from the top wall to the bottom edge portion, and only two catch means are provided, at circumferentially diametrically opposite positions.

4. A package as claimed in claim 1 wherein the catch means comprises an outwardly facing, upwardly and inwardly sloped cam surface to be contacted by said blight and guide the blight upward into engagement with said upper catch surface on pivoting the hook member upwardly toward the cover means.

5. A package as claimed in claim 4 wherein said cam surface has an uppermost end raised above the upper catch surface to form outwardly of the catch surface a raised inwardly facing shoulder to catch the blight and resist removal of the blight from engagement with the upper catch surface.

6. A package as claimed in claim 5 wherein the catch means is resiliently deformable to permit said blight to pass over said shoulder to couple and uncouple the cover means to the base means.

* * * * *